US010597786B2

(12) United States Patent
Rokitta

(10) Patent No.: US 10,597,786 B2
(45) Date of Patent: Mar. 24, 2020

(54) RUST PARTICLE REMOVER FOR SILVERWARE/POTS/PANS AND LAUNDRY

(71) Applicant: Rokitta's GmbH, Stuttgart (DE)

(72) Inventor: Oliver Rokitta, Stuttgart (DE)

(73) Assignee: Rokitta's GmbH, Stuttgart (DE)

( * ) Notice: Subject to any disclaimer, the term of this patent is extended or adjusted under 35 U.S.C. 154(b) by 163 days.

(21) Appl. No.: 15/951,203

(22) Filed: Apr. 12, 2018

(65) Prior Publication Data

US 2019/0316263 A1 Oct. 17, 2019

(30) Foreign Application Priority Data

Apr. 11, 2018 (DE) ..... 20 2018 101 946 U

(51) Int. Cl.
*C23F 15/00* (2006.01)
*A47L 15/42* (2006.01)
*H01F 7/02* (2006.01)

(52) U.S. Cl.
CPC ..... *C23F 15/005* (2013.01); *A47L 15/42* (2013.01); *H01F 7/02* (2013.01)

(58) Field of Classification Search
USPC ..... 205/724; 210/222
See application file for complete search history.

(56) References Cited

U.S. PATENT DOCUMENTS 5,264,832 A * 11/1993 Parmer ..... G01V 3/02
324/204

FOREIGN PATENT DOCUMENTS

DE 102010047691 A1 * 4/2012 ..... A47L 15/42
DE 202016007009 U1 2/2017

OTHER PUBLICATIONS

Raetz, DE102010047691, English machine translation, pp. 1-4 (Year: 2012).*
Rokitta, DE202016007009, English machine translation, pp. 1-3 (Year: 2017).*

* cited by examiner

*Primary Examiner* — Claire A Norris
(74) *Attorney, Agent, or Firm* — Michael Soderman

(57) ABSTRACT

A rust particle remover, comprising a core (1) and an outer sleeve (2). The core (1) is made up of a magnet comprising a magnetic field strength of at least 13.2 Tesla and is introduced into the outer sleeve (2) by means of pressure pressing. The patent application is based on the problem of preventing signs of rust on cutlery and metal parts caused by rust particles, which are transported by tap water.

15 Claims, 2 Drawing Sheets

Fig 2A Fig. 2B Fig. 2C
Fig. 1
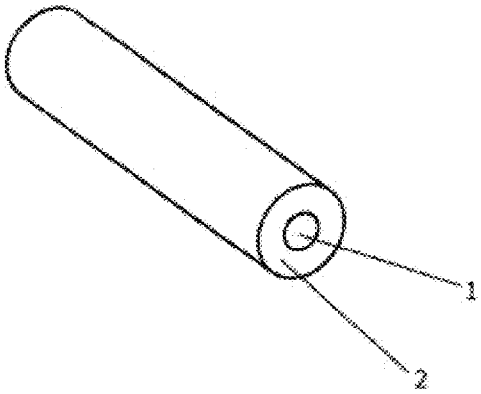
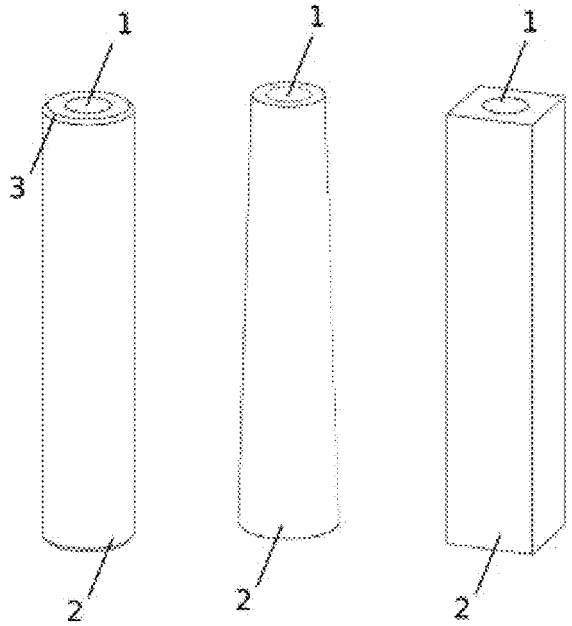
Fig. 2D Fig. 2E Fig. 2F
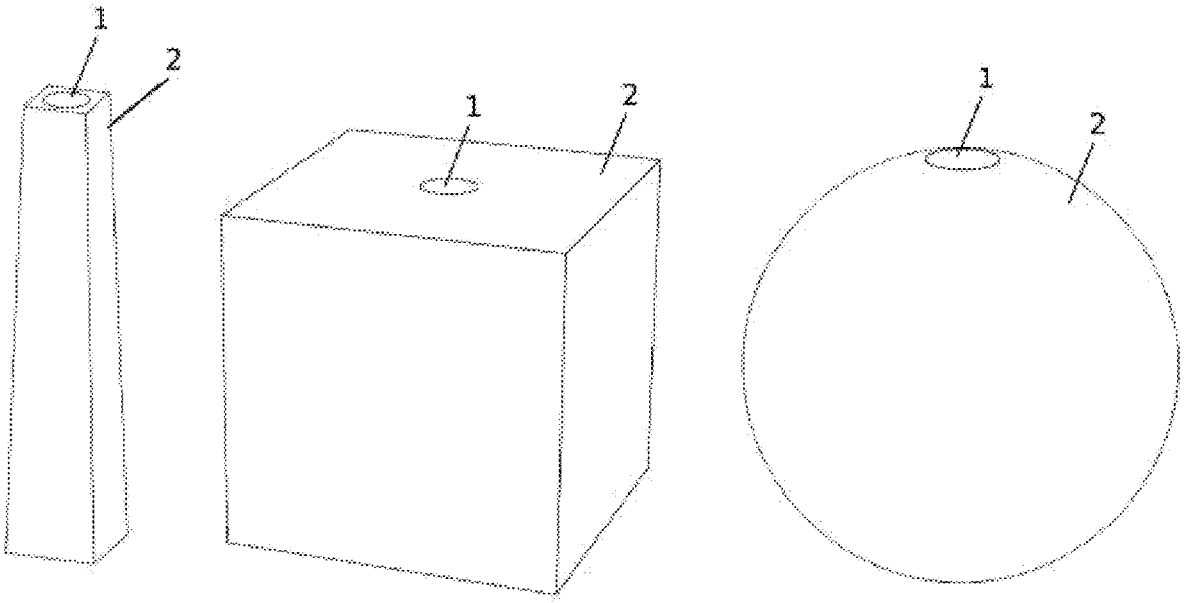

RUST PARTICLE REMOVER FOR SILVERWARE/POTS/PANS AND LAUNDRY

CROSS REFERENCE TO RELATED APPLICATIONS

This application claims the priority of DE 202018101946.5 filed on 2018 Apr. 11; this application is incorporated by reference herein in its entirety.

BACKGROUND

The invention relates to a rust particle remover, as well as to a casing therefor, to avoid rust stains in and in response to the use of household appliances.

In response to regular washing processes, cutlery and metal parts end up with signs of rust (surface rust) in the dishwasher as a result of rust particles in the tap water. These signs of rust do not look appetizing and are unwanted on cutlery and metal parts.

This unpleasant surface rust can have different causes: Rust in the water pipes in or to the house, a defective cutlery basket in the dishwasher or rusty parts on pots, pans and knives. The shiny cutlery can also become spotty very quickly in this way.

SUMMARY

A rust particle remover, comprising a core (1) and an outer sleeve (2). The core (1) is made up of a magnet comprising a magnetic field strength of at least 13.2 Tesla and is introduced into the outer sleeve (2) by means of pressure pressing.

DETAILED DESCRIPTION

The present invention is based on the problem of preventing signs of rust on cutlery and metal parts caused by rust particles, which are transported by tap water.

According to the invention, the above object is solved by means of the features of the independent claims. Advantageous embodiments are described in the subclaims.

For this purpose, a rust particle remover is proposed, which comprises a core and an outer sleeve. The core consists of a magnet comprising a magnetic field strength of at least 13.2 Tesla or 132000 Gauss, respectively. The core is introduced into the outer sleeve by means of pressure pressing or is connected thereto, respectively, in a non-positive and/or positive manner.

It is attained by means of the invention that the rust particles are pulled from a fluid, e.g. tap water, and deposit on the invention, that is the rust particle remover. The rust particles, which are thus secured, can no longer deposit on other objects, such as metal parts, machine parts, cutlery, dishes or textiles.

Rust particles can be created, e.g. by means of so-called surface rust. The magnetic effect can partially also be present as a result of metallic components, which still adhere to the rust particles or which transition into them in one piece, respectively. As a result of the magnetic effect, the particles can be drawn in by the rust particle remover.

Advantageously, this works without the use of chemicals, so that e.g. dishes or textiles, which come into contact with the skin, are not additionally impacted negatively.

The functional effect of the rust particle remover is realized by means of the magnet, which attracts the particles. An outer sleeve can increase the effective surface (as compared to that the magnet). More particles can thus be attracted or bound, respectively. At the same time, an unnecessarily large magnet does not need to be used. According to the invention, an advantageous magnet, which meets the necessary specifications, in combination with an outer sleeve is thus proposed, which has a large surface.

It has been shown that a magnetic field strength starting at 13.2 Tesla is particularly advantageous to manage the desired effect of attracting the particles. The necessary field strength is also a function of the geometry of the outer sleeve, because the latter can reduce the effective field strength in the fluid as a result of its expansion distance.

With regard to the construction, a core and an outer sleeve are present, which are connected to one another by means of a press fit. The core consists of a magnet or comprises it, respectively.

In a preferred embodiment of the rust particle remover, the core consists of a polished magnet.

It thus has a smooth surface, which seals in such a way, e.g. with the pressure-pressed connection to the outer sleeve in such a way that the fluid cannot enter into the gap between core and outer sleeve. Rusting of the magnet can thus be avoided.

In a preferred embodiment of the rust particle remover, the core consists of a neodymium magnet.

Such a magnet is the strongest commercially available permanent magnet, which still maintains its ferromagnetic properties at room temperature and is thus suitable for the application purpose.

In a preferred embodiment of the rust particle remover, the magnet of the core is anodized.

It is avoided through this that the magnet or core, respectively, corrodes.

In a preferred embodiment of the rust particle remover, the core has a diameter of 10 mm and a length of 100 mm.

It has been shown that the use of this geometry is suitable for certain applications and that an advantageous field line distribution in the room is ensured at the same time. With this dimensioning, the interior of a dishwasher can thus be covered for the rust particle-attracting effect.

In a preferred embodiment of the rust particle remover, the outer sleeve consists of aluminum or substantially of aluminum, respectively.

Aluminum is particularly suitable as material for the outer sleeve, because it does not rust.

In a preferred embodiment of the rust particle remover, the outer sleeve consists of a silicon-free aluminum alloy.

It has been shown that silicon-containing aluminum alloys reduce the rust-attracting effect. Such compounds should thus generally be avoided.

In a preferred embodiment of the rust particle remover, the diameter of the outer sleeve is 20 mm.

As a result of this dimensioning, a ratio between thickness of the core and thickness of the outer sleeve is formed, which represents a good compromise between the size of the surface of the rust particle remover and the necessary strength of the magnet.

In a preferred embodiment of the rust particle remover, the outer sleeve has a recess in the center comprising a diameter of the size of the core diameter for accommodating the core. It can in particular have a size of 10 mm.

This dimensioning provides for a press fit between core and outer sleeve. The central arrangement provides for the even effect of the magnet in all directions.

In a preferred embodiment of the rust particle remover, the surface of the outer sleeve has a fluting.

The particles can deposit in the depressions of these flutings, without being washed away again by the fluid or being mechanically rubbed away again. The depressions at least reduce this risk as compared to a smooth surface.

In a preferred embodiment of the rust particle remover, the structure of the fluting has a depth of between 8.87 μm and 0.5 mm.

It has been shown that, starting at a depth of 8.87 μm, rust particles adhere effectively to the outer sleeve. A depth of more than 0.5 mm bears the risk that germs and dirt particles deposit in an unwanted manner.

In a preferred embodiment of the rust particle remover, the fluting is rotated or is milled by means of a CNC method or is applied by means of a laser.

Common production methods, such as CNC milling or laser structuring can represent advantageous methods for applying the desired fluting to the outer sleeve.

In a preferred embodiment of the rust particle remover, the latter can be inserted into a cutlery basket or a cutlery tray of a dishwasher. In this application, it serves to prevent rust marks on cutlery, pots, pans or metal parts.

It is attained by means of the invention that the rust particles are pulled out of the tap water during the washing process. These particles instead deposit on the rust particle remover. Cutlery, dishes and metal parts are thus spared from the rust particles.

The rust particle remover can easily be placed e.g. into the cutlery basket or cutlery tray of the dishwasher. Surface rust is literally attracted by the rust particle remover and can thus no longer deposit on cutlery, pots and pans.

Rust spots on cutlery, pots and pans are thus reduced or avoided respectively, but remain/become in fact sparkling clean without using chemicals. The dishwasher itself and its machine parts are protected against surface rust and thus gain a service life, which may be longer. A simple handling is ensured by insertion into the cutlery basket/tray prior to the washing process.

The rust particle remover is handled as follows for a washing process of a dishwasher:

1. The rust particle remover is placed into the cutlery basket in the dishwasher.
2. The dishwasher is continued to be loaded in its regular way with dishes/cutlery.
3. The loaded dishwasher is turned on.
4. After the washing process, the invention remains in the cutlery basket for approx. 600 washing processes, before it should be replaced.

In addition, the pH value in the dishwasher is lowered from 7 to 5 (measured at 12-30 l of water and 45-65° C.) by means of the rust particle remover. The necessary use of washing or dishwashing detergent is thus also reduced.

In a preferred embodiment of the rust particle remover, the latter is embodied to attract surface rust.

In a preferred embodiment of the rust particle remover, the latter is embodied to clean silver, according to the principle of aluminum foil and salt.

An additional application inside or outside of a dishwasher is thus possible. In a preferred embodiment of the rust particle remover, the rust particle remover has a cylindrical, cylindrically beveled, conical, cuboid-shaped, truncated pyramid-shaped, cubical, ellipsoid-shaped or ball-shaped shape.

Depending on the intended use, the rust particle remover has to come to rest in a positive manner. This can be ensured by means of a corresponding shape. A cylindrical shape can be suitable for the lose insertion, a conical shape for securing in a hole, a cuboid-shaped shape for avoiding a rotation, a cubical shape for a simple insertion in any orientation, an ellipsoid or ball-shaped shape for the free movement in a room.

A beveling of edges can prevent damages to objects, with which the rust particle remover comes into contact.

In a specific embodiment, a correspondingly formed rust particle remover can be placed into a cutlery tray, which is located, e.g., in the refrigerator/drawer. Unsightly surface rust spots on the cutlery can thus also be prevented there.

In a preferred embodiment of the rust particle remover, the outer sleeve has a single bore for accommodating the core.

The term core is to thereby be understood in such a way that it reaches at least slightly into the outer sleeve. It has been shown that the core does not necessarily need to reach through the entire body. According to an embodiment, it is provided in this regard that the core corresponds to less than half, more preferably less than one-fourth, of the length of the outer sleeve. Costs can be saved through this without reducing the effect.

For fastening the core, the latter can be pressed into the outer sleeve, so that it is sunk, e.g., in the outer sleeve. For certain applications, a dismantling or disassembly, respectively, can be prevented in an advantageous manner.

In a special embodiment of the rust particle remover, the outer sleeve has a continuous bore, i.e. comprising two openings.

A tool can be introduced through the second opening and the core can be pushed out of the first opening again, e.g. to only replace the magnet or the outer sleeve, e.g. at the end of the service life.

It is preferred, however, that the outer sleeve does not have a continuous bore, but is particularly preferably bored only less than 1 cm, for example 4 mm. A disc magnet is then preferably pressed into this bore, for example a neodymium disc magnet 10×4 mm neodymium, yellow galvanized.

A casing according to the invention for accommodating a rust particle remover according to the invention is also proposed. A soft casing surrounds the core and the outer sleeve and is embodied to dampen mechanical impact forces of the comparatively hard core or outer sleeve, or of the rust particle remover, respectively.

The difference in the degree of hardness between the (soft) casing and the (hard) rust particle remover needs to be selected according to the application purpose. On principle, the casing is softer than the rust particle remover or the components core and outer sleeve thereof, respectively.

The appliance, in which the rust particle remover is used, or objects, which come into contact therewith, respectively, can thus be protected against mechanical application of a force therefrom, in particular when the rust particle remover is set in motion by means of an appliance, e.g. household appliance, and can collide with objects.

The casing should thereby be formed geometrically in such a way that no corners or edges of the rust particle remover can come into direct contact with the objects, which are to be protected.

In a special embodiment of the casing, the latter consists of thermoelastic material.

The thermoelastic effect can thus be utilized advantageously.

In a special embodiment of the casing, the latter has openings.

These openings make it possible that a fluid or the rust particles, respectively, can flow through the casing and can come into contact with the outer sleeve or the core. The particle-binding effect is thus ensured and simultaneously a mechanical protection against impacts.

In a special embodiment of the casing, the latter consists of an upper and lower half shell.

A rust particle remover can thus be placed into the interior of these two half shells and can thus be coated.

In a special embodiment of the casing, the two half shells can be connected in a positive manner by means of clip or latching lugs in such a way that a rust particle remover according to the invention is also connected to the half shells in a positive manner.

Clip and latching mechanism are known connecting elements, which can be produced in a cost-efficient manner. Injection molding is a possible method for the plastics, which can mostly be used here as well, for the production of the two half shells. The geometry of the half shell arrangement is to be designed in such a way that the rust particle remover can be placed into the lower half shell, preferably into a geometric device, which is provided for this purpose. The upper half shell is then pushed onto the lower half shell like a cover, until the lugs engage like groove and spring. The upper half shell thereby has a geometric shape, so that the rust particle remover has room between both half shells, but is secured in a positive manner. As an alternative to the clearance fit, a press fit can also be advantageous.

In a special embodiment of the casing, the latter is suitable to be placed into the washing drum of a washing machine or of a clothes dryer.

The casing prevents damages to the washing drum, which would have to be expected without such a casing, as a result of the hardness of the metal of the rust particle remover.

The use of the rust particle remover in a washing machine or a clothes dryer prevents surface rust on appliance components, which could reduce the service life of the machine on the one hand, and which could otherwise also discolor the laundry.

BRIEF DESCRIPTION OF THE DRAWINGS

Exemplary embodiments of the invention will be described in more detail below by means of the drawings.

FIG. 1 shows a rust particle remover

FIG. 2A shows a beveled rust particle remover

FIG. 2B shows a conical rust particle remover

FIG. 2C shows a cuboid-shaped rust particle remover

FIG. 2D shows a truncated pyramid-shaped rust particle remover

FIG. 2E shows a cubical rust particle remover

FIG. 2F shows a ball-shaped rust particle remover

DETAILED DESCRIPTION OF THE PREFERRED EMBODIMENTS

FIG. 1 shows a rust particle remover, which consists of two components, a core 1, which preferably consists of a magnet, and an outer sleeve 2. A cylindrical shape of the rust particle remover is illustrated.

FIG. 2A illustrates the same rust particle remover as in FIG. 1, with the difference that a bevel 3 is attached to the exposed edge of the outer sleeve.

FIG. 2B illustrates a rust particle remover, the outer sleeve 2 of which has a conical shape.

FIG. 2C illustrates a rust particle remover, the outer sleeve 2 of which has a cuboid-shaped shape (square).

FIG. 2D illustrates a rust particle remover, the outer sleeve 2 of which has a truncated pyramid-shaped shape.

FIG. 2E illustrates a rust particle remover, the outer sleeve 2 of which has a cubical shape.

FIG. 2F illustrates a rust particle remover, the outer sleeve 2 of which has a ball-shaped shape.

The core 1 is embodied in a cylindrical shape in all figures.

Figure 3A:
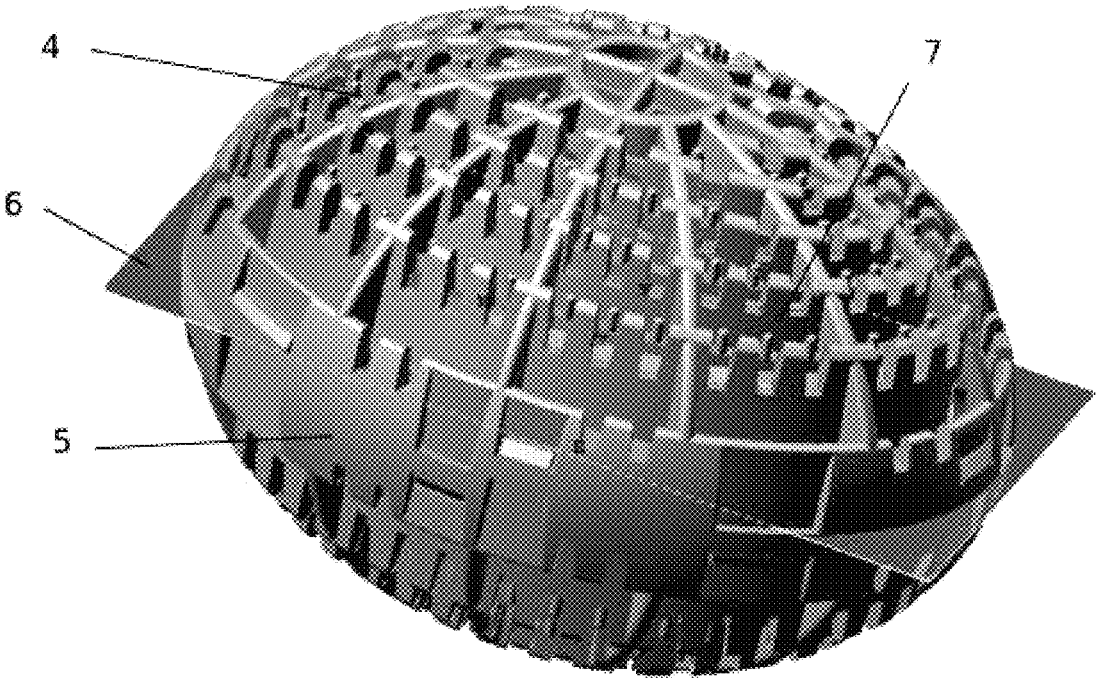
FIG. 3A shows a casing

FIG. 3A shows a casing, which consists of an upper half shell 4 and a lower half shell 5, which can be separated from one another by means of a virtual separating plane 6 or which are embodied in two pieces, respectively. An ellipsoid shape of the casing is illustrated, which additionally has openings 7, which make it possible that a fluid can flow into the interior of the casing.

Figure 3B:
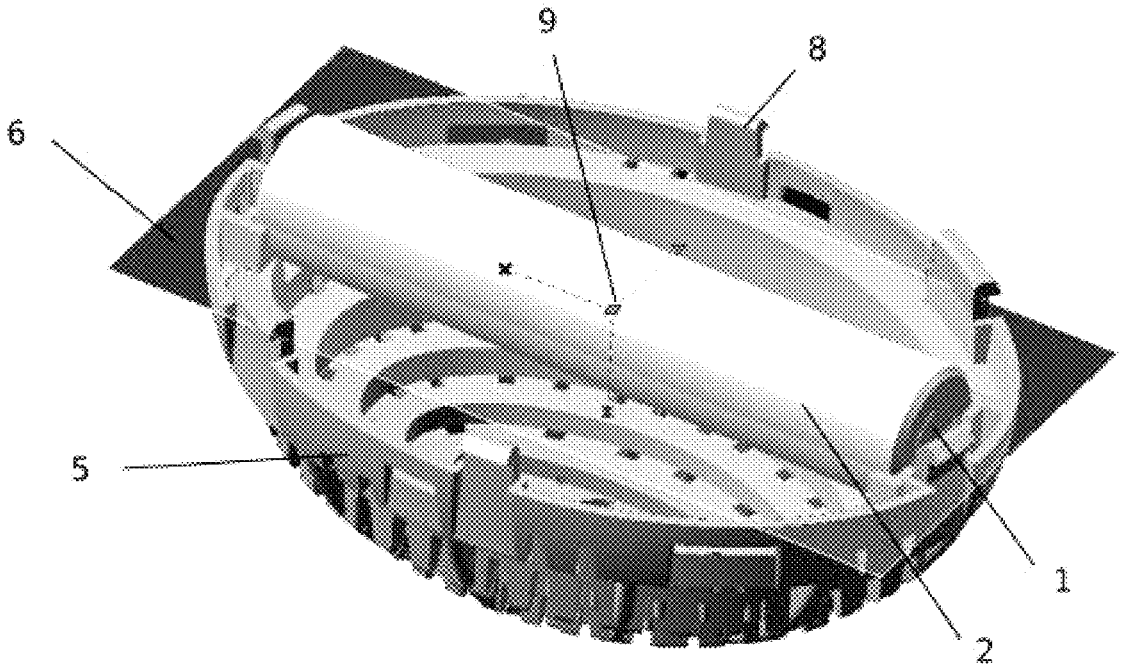
FIG. 3B shows an open casing

FIG. 3B shows an open casing, i.e. the upper half shell 4 is not illustrated. The inner workings of the casing thus becomes visible, in particular the inserted rust particle remover, comprising the outer sleeve 2 and the core 1. In response to the assembly, circumferential clip lugs or springs 8, respectively, in the lower half shell 5 engage with grooves, which are located in the upper half shell 4 and thus connect both half shells 4 and 5 in a positive manner. The rust particle remover, which is inserted, is thereby secured as well. A coordinate cross 9 clarifies the geometry or the three-dimensional orientation, respectively, of FIGS. 3A and 3B.

LIST OF REFERENCE NUMERALS

1 core
2 outer sleeve
3 bevel
4 upper half shell
5 lower half shell
6 separating plane
7 opening(s)
8 clip lug
9 coordinate cross

The invention claimed is:

1. A rust particle remover, comprising a core (1) and an outer sleeve (2),
characterized in that
the core (1) is made up of a magnet comprising a magnetic field strength of at least 13.2 Tesla,
wherein the core (1) is introduced into the outer sleeve (2) by means of pressure pressing, and wherein
the surface of the outer sleeve (2) has a fluting, the structure of which has a depth of between 8.87 μm and 0.5 mm.

2. The rust particle remover according to claim 1,
characterized in that
the core (1) is made up of a polished magnet and/or neodymium magnet.

3. The rust particle remover according to claim 1,
characterized in that
the magnet of the core (1) is anodized.

4. The rust particle remover according to claim 1,
characterized in that
the core (1) has a diameter of 10 mm and a length of between 4 mm and 100 mm.

5. The rust particle remover according to claim 1,
characterized in that
the outer sleeve (2) is made up of aluminum or substantially of aluminum, respectively.

6. The rust particle remover according to claim 1,
characterized in that the diameter of the outer sleeve (2) is 20 mm and has a recess in the center comprising a diameter of the size of the core diameter for accommodating the core (1).

7. The rust particle remover according to claim 1, characterized in that the fluting is rotated or is milled by means of a CNC method or is applied by means of a laser.

8. The rust particle remover according to claim 1, characterized in that the rust particle remover is designed so as to be capable of being inserted into a cutlery basket or a cutlery tray of a dishwasher and serves to prevent rust marks on cutlery, pots, pans or metal parts.

9. The rust particle remover according to claim 1, characterized in that the rust particle remover is embodied to attract surface rust and/or is also embodied to clean silver.

10. The rust particle remover according to claim 1, characterized in that the rust particle remover has a cylindrical, cylindrically beveled, conical, cuboid-shaped, truncated pyramid-shaped, cubical, ellipsoid-shaped or ball-shaped shape.

11. The rust particle remover according to claim 1, characterized in that the outer sleeve (2) has a single bore for accommodating the core (1).

12. The rust particle remover according to claim 1, characterized in that a soft casing surrounds the core (1) and the outer sleeve (2) and is embodied to dampen mechanical impact forces of the comparatively hard core (1) or outer sleeve (2).

13. The rust particle remover according to claim 12, characterized in that the casing (4, 5) is made up of thermoelastic material, which has openings (7), which make it possible that a fluid or rust particle, respectively, can come into contact with the outer sleeve (2) or the core (1).

14. The rust particle remover according to claim 12, characterized in that the casing (4, 5) is made up of an upper (4) and lower (5) half shell, which connect both half shells by means of clip or latching lugs (8) in such a way that the rust particle remover is also connected to the half shells.

15. The rust particle remover according to claim 12, characterized in that the casing (4, 5) is suitable to be placed into the washing drum of a washing machine or of a clothes dryer, without causing damages to the washing drum.

* * * * *